US009384911B2

(12) United States Patent
Kapples et al.

(10) Patent No.: US 9,384,911 B2
(45) Date of Patent: Jul. 5, 2016

(54) ELECTRICAL SWITCHING APPARATUS AND DAMPENING ASSEMBLY THEREFOR

(71) Applicant: EATON CORPORATION, Cleveland, OH (US)

(72) Inventors: Lawrence Joseph Kapples, Pittsburgh, PA (US); James Alan Trax, Oakdale, PA (US)

(73) Assignee: EATON CORPORATION, Cleveland, OH (US)

( * ) Notice: Subject to any disclaimer, the term of this patent is extended or adjusted under 35 U.S.C. 154(b) by 174 days.

(21) Appl. No.: 14/244,130

(22) Filed: Apr. 3, 2014

(65) Prior Publication Data

US 2015/0287554 A1 Oct. 8, 2015

(51) Int. Cl.
*H01H 3/60* (2006.01)
*H01H 71/10* (2006.01)

(52) U.S. Cl.
CPC . *H01H 3/60* (2013.01); *H01H 71/10* (2013.01)

(58) Field of Classification Search
CPC ..... H01H 3/60
USPC ..... 200/288, 301
See application file for complete search history.

(56) References Cited

U.S. PATENT DOCUMENTS 4,264,225 A * 4/1981 Cassell ..... B41J 5/08 400/478
4,612,429 A * 9/1986 Milianowicz ..... F16F 7/00 200/288
5,025,236 A * 6/1991 Miura ..... H01H 3/60 335/202
6,025,236 A 2/2000 Mathews
7,459,650 B2 12/2008 Weister et al.
7,518,076 B1 4/2009 Gottschalk et al.
8,471,654 B1 6/2013 Shanmugaraj et al.
8,507,817 B2 8/2013 Gottschalk et al.
8,563,887 B2 10/2013 Gottschalk et al.

FOREIGN PATENT DOCUMENTS

NL 122 117 C 4/1967

OTHER PUBLICATIONS

European Patent Office, "International Search Report and Written Opinion", PCT/US2015/017636, Jun. 5, 2015, 11 pp.

* cited by examiner

*Primary Examiner* — Renee Luebke
*Assistant Examiner* — Lheiren Mae A Caroc
(74) *Attorney, Agent, or Firm* — Eckert Seamans Cherin & Mellott, LLC; Grant E. Coffield

(57) ABSTRACT

A dampening assembly is for an electrical switching apparatus, such as a circuit breaker. The electrical switching apparatus includes a housing, separable contacts enclosed by the housing, and an operating mechanism structured to open and close the separable contacts. The dampening assembly includes a D-shaft pivotably coupled to the housing, and an anti-bounce assembly. The anti-bounce assembly includes a first element coupled to the housing, and a second element, such as an elongated resilient pin member, which is adapted to cooperate with the D-shaft to resist undesired movement of the D-shaft. The D-shaft has opposing first and second ends and a recess disposed between the first end and the second end. A portion of the elongated resilient pin member is disposed in the recess.

18 Claims, 4 Drawing Sheets

ELECTRICAL SWITCHING APPARATUS AND DAMPENING ASSEMBLY THEREFOR

BACKGROUND

1. Field

The disclosed concept relates generally to electrical switching apparatus and, more particularly, to electrical switching apparatus such as for example, circuit breakers. The disclosed concept also relates to dampening assemblies for circuit breakers.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts that are separable from the stationary electrical contacts.

Among other components, the operating mechanisms of some low and medium voltage circuit breakers, for example, typically include a closing assembly and an opening assembly that are structured to close (e.g., contacts electrically connected) and open (e.g., contacts separated), respectively, the separable contacts. Specifically, the operating mechanism includes a pole shaft, a number of stored energy devices such as, for example, an opening spring and a closing spring, and a latch assembly that cooperates directly or indirectly with the pole shaft to facilitate desired movement of the separable contacts.

The basic components of the latch assembly typically include a D-shaft and a latch (e.g., plate member) that cooperates with the D-shaft, but is disposed on a separate shaft. That is, the latch rotates with the separate shaft about the longitudinal axis of the separate shaft. The D-shaft includes a slot such that it blocks movement of the latch when the D-shaft is disposed in a corresponding range of axial positions, but permits movement of the latch, through the slot, when the D-shaft is disposed in a particular predetermined axial position. Sometimes, however, the D-latch does not come to an ideal resting position during operation, which can have an adverse impact on circuit breaker function. By way of example, if the D-latch is sufficiently out of position, the latch (e.g., trip latch) will not close. Such problems are primarily caused by shock and/or vibration in the system, which can cause components, including the D-shaft, to bounce and/or flutter and ultimately come to rest in an undesirable position.

There is, therefore, room for improvement in electrical switching apparatus, such as circuit breakers, and in dampening assemblies therefor.

SUMMARY

These needs and others are met by embodiments of the disclosed concept, which are directed to a dampening assembly for electrical switching apparatus.

As one aspect of the disclosed concept, a dampening assembly is provided for an electrical switching apparatus. The electrical switching apparatus includes a housing, separable contacts enclosed by the housing, and an operating mechanism structured to open and close the separable contacts. The dampening assembly comprises: a D-shaft structured to be pivotably coupled to the housing; and an anti-bounce assembly comprising a first element structured to be coupled to the housing, and a second element adapted to cooperate with the D-shaft to resist undesired movement of the D-shaft.

The D-shaft may comprise a first end, a second end disposed opposite and distal from the first end, and a recess disposed between the first end and the second end. A portion of the second element may be disposed in the recess. The D-shaft may comprise a longitudinal axis and the recess may comprise a groove having a transverse axis, wherein the transverse axis of the groove is substantially perpendicular to the longitudinal axis of the D-shaft. The second element may be an elongated resilient pin member, wherein the elongated resilient pin member extends outwardly from the first element of the anti-bounce assembly. The D-shaft may include a closed position corresponding to the separable contacts being closed. When the D-shaft is disposed in the closed position, the elongated resilient pin member may be disposed in the groove and the transverse axis of the groove may be substantially parallel to the elongated resilient pin member. When the D-shaft is not in the closed position, the elongated resilient pin member may bias the D-shaft toward the closed position.

As another aspect of the disclosed concept, an electrical switching apparatus comprises: a housing; separable contacts enclosed by the housing; an operating mechanism for opening and closing the separable contacts; and a dampening assembly comprising: a D-shaft pivotably coupled to the housing, and an anti-bounce assembly comprising a first element coupled to the housing, and a second element adapted to cooperate with the D-shaft to resist undesired movement of the D-shaft.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
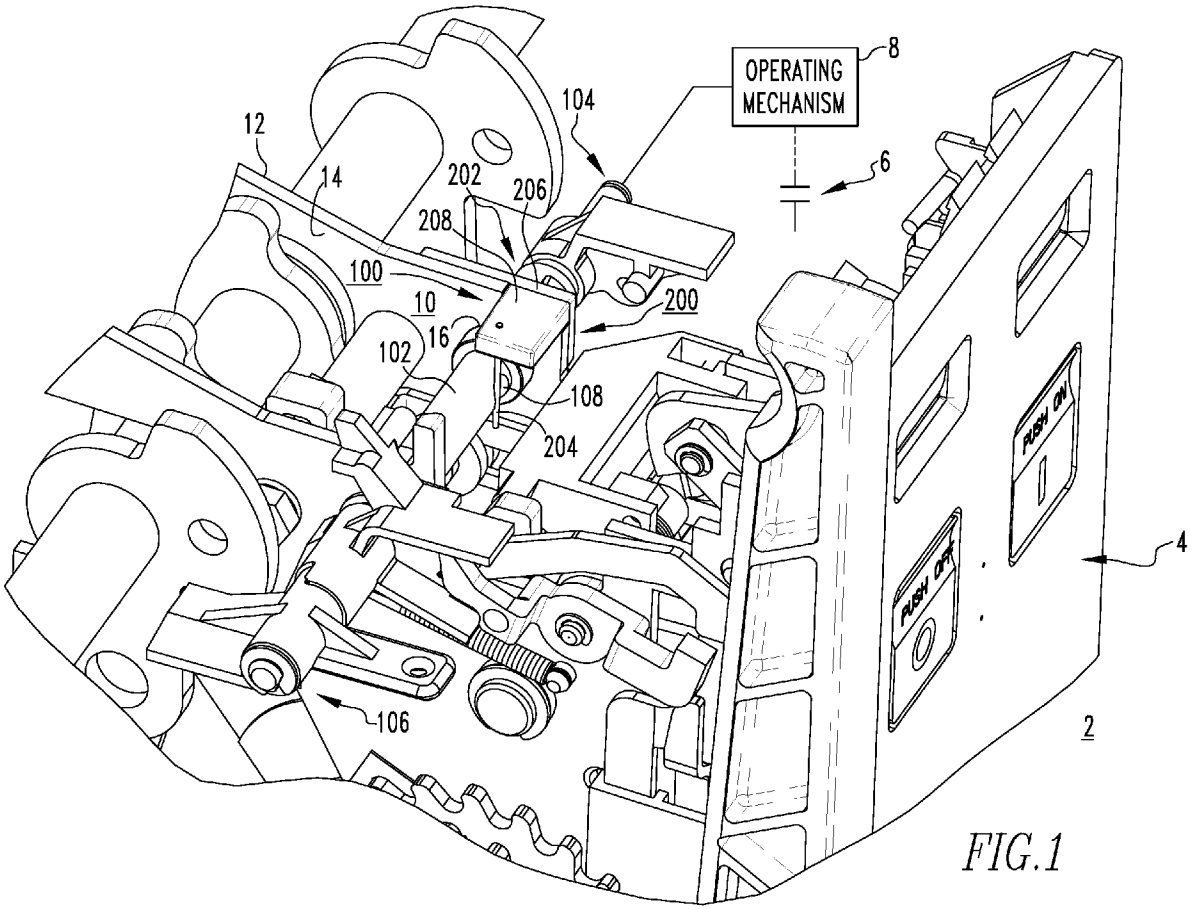
FIG. 1 is an isometric view of a portion of an electrical switching apparatus and dampening assembly therefor, in accordance with an embodiment of the disclosed concept.

For purposes of illustration, embodiments of the invention will be described as applied to medium and low voltage circuit breakers, although it will become apparent that they could also be applied to the charging assemblies of any known or suitable electrical switching apparatus (e.g., without limitation, circuit switching devices and circuit interrupters such as circuit breakers other than medium and low voltage circuit breakers, network protectors, contractors, motor starters, motor controllers and other load controllers).

Directional or positional phrases used herein, such as, for example, vertical, parallel, perpendicular and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
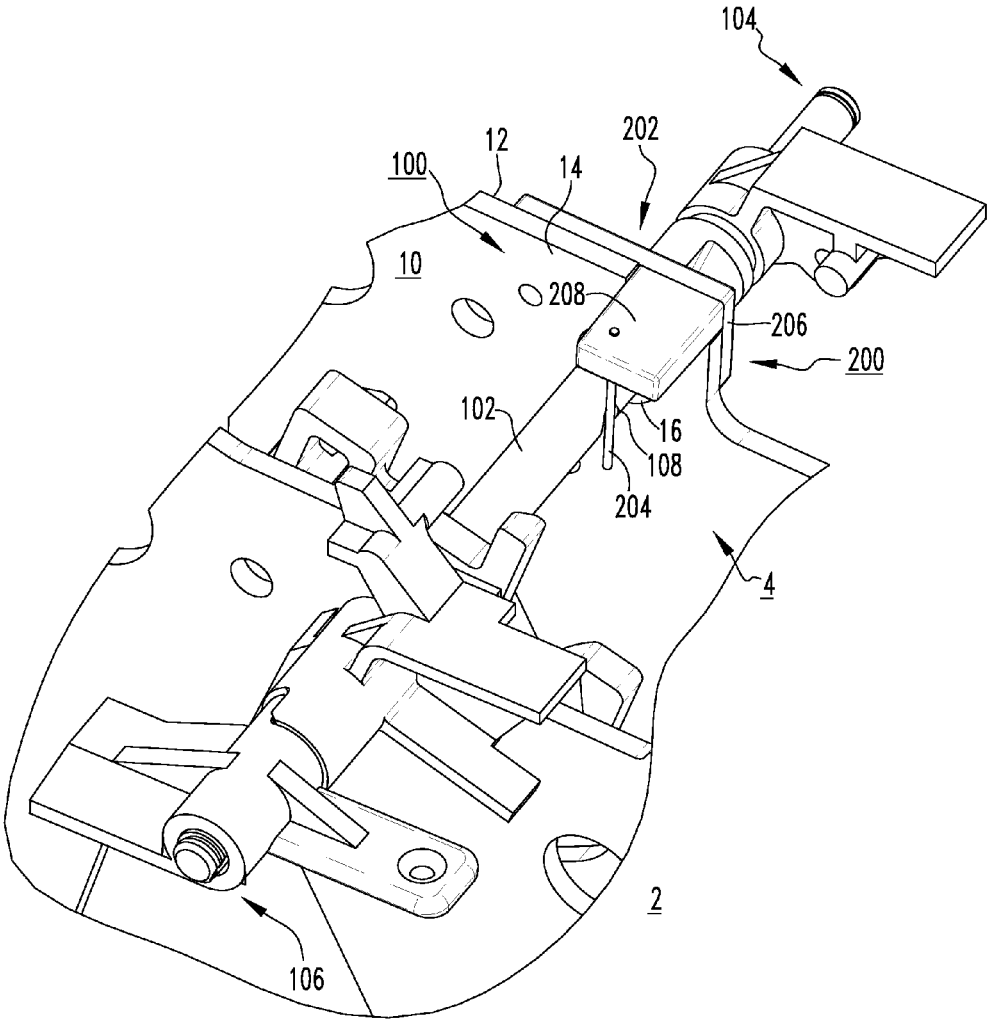
FIG. 2 is an enlarged isometric view of the dampening assembly of FIG. 1.

FIGS. 1 and 2 show a dampening assembly 100 for an electrical switching apparatus, such as for example and without limitation, the circuit breaker 2, partially shown. The circuit breaker 2 includes a housing 4 (partially shown), separable contacts 6 (shown in simplified form in FIG. 1) enclosed by the housing 4, and an operating mechanism 8 (shown in simplified form in FIG. 1) structured to open and close the separable contacts 6.

The dampening assembly 100 includes a D-shaft 102, which is structured to be pivotably coupled to the circuit breaker housing 4, and an anti-bounce assembly 200. The anti-bounce assembly 200 includes a first element 202, also structured to be coupled to the housing 4, and a second element 204 adapted to cooperate with the D-shaft 102 to resist undesired movement of the D-shaft 102. More specifically, as will be described in greater detail hereinbelow, the second element 204 cooperates with (e.g., without limitation, engages and biases) the D-shaft 102 to resist or avoid flutter or vibration of the D-shaft 102, and to insure the D-shaft 102 consistently comes to the desired rest position. In this manner, the disclosed dampening assembly 100 serves to address and overcome disadvantages associated with conventional latch assemblies and D-shafts therefor (not shown).

Figure 3:
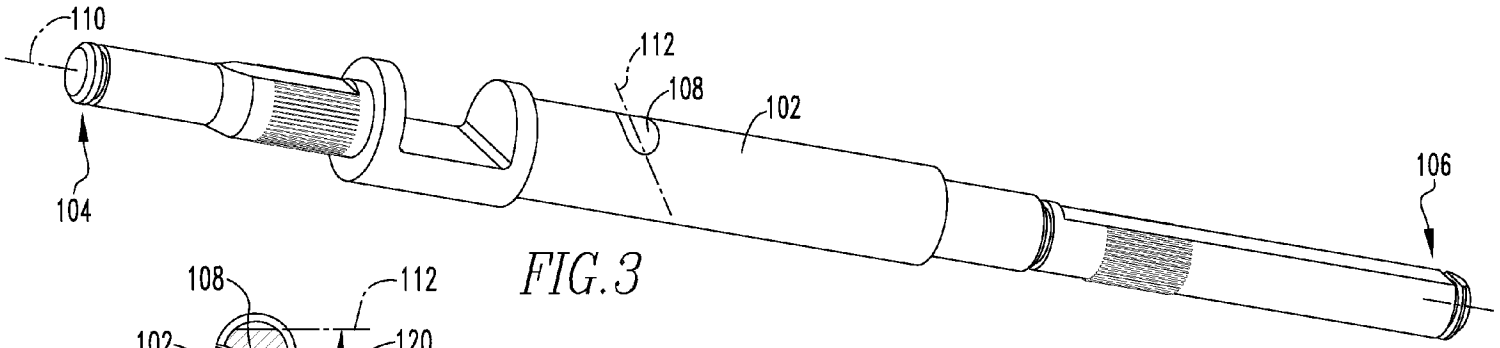
FIG. 3 is an isometric view of the D-shaft for the dampening assembly of FIG. 2.
Figure 4A:
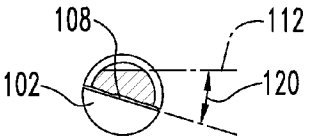
FIG. 4A is a section view taken along line 4A-4A of FIG. 4.
Figure 4:
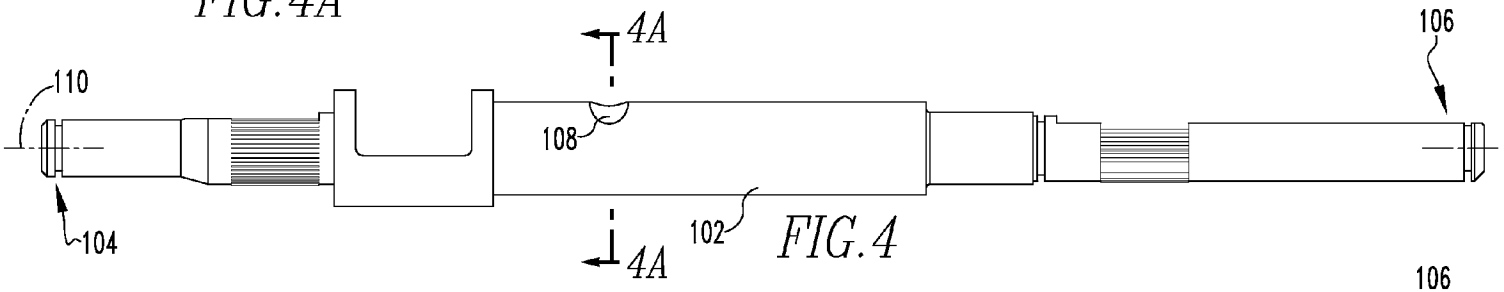
FIG. 4 is a side elevation of the D-shaft of FIG. 3.
Figure 5:
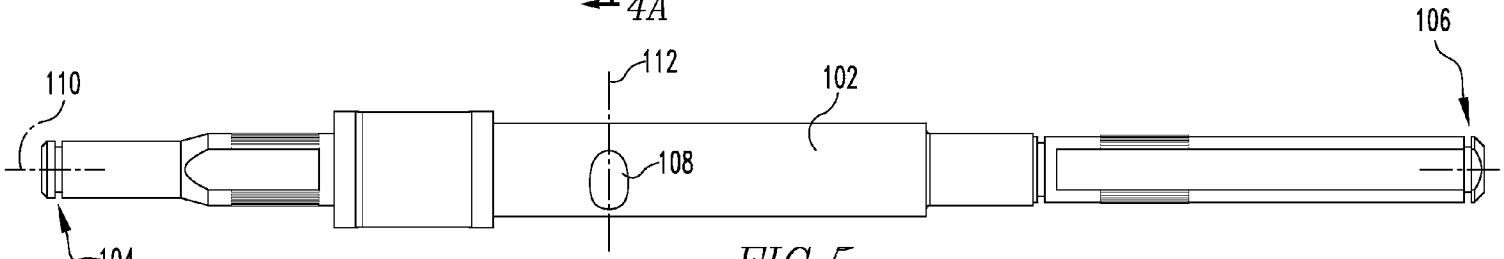
FIG. 5 is a top plan view of the D-shaft of FIG. 4.

Continuing to refer to FIGS. 1 and 2, and also to FIGS. 3-5, it will be appreciated that the D-shaft 102 in the example shown and described herein includes first end 104 and a second end 106 disposed opposite and distal from the first end 104. A recess 108 is disposed between the first end 104 and the second end 106. A portion of the second element 204 of the anti-bounce assembly 200 is disposed in the recess 108, as best shown in FIG. 2. As shown in FIGS. 3-5, the D-shaft 102 has a longitudinal axis 110, and the recess 108 preferably comprises a groove 108 having a transverse axis 112. The transverse axis 112 is preferably substantially perpendicular to the longitudinal axis 110 of the D-shaft 102 (best shown in the top plan view of FIG. 5).

As best shown in the section view of FIG. 4A, the example groove 108 forms an angle 120 with respect to the transverse axis 112 of the D-shaft 102. The angle 120 is preferably between about 5 degrees and about 30 degrees, and more preferably is about 17 degrees. It will be appreciated that such configuration functions to facilitate cooperation between the aforementioned second element 204 (FIGS. 1, 2 and 6-8) of the anti-bounce assembly 200 (FIGS. 1, 2 and 6-8), as will now be described in greater detail.

Figure 6:
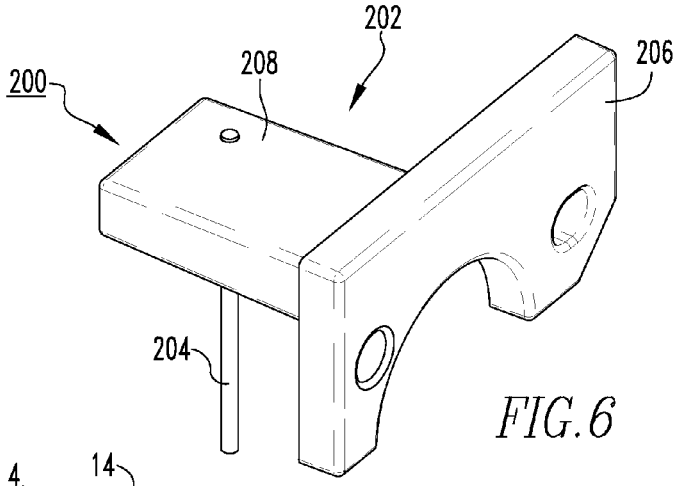
FIGS. 6-8 are isometric assembled, isometric exploded and end elevation views, respectively, of the anti-bounce assembly for the dampening assembly of FIG. 2.
Figure 7:
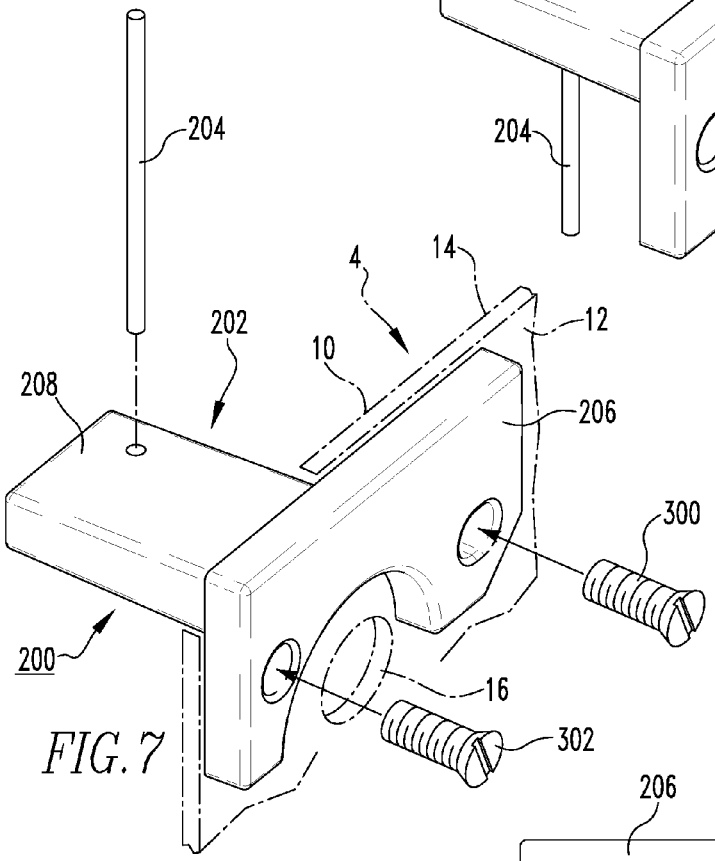
Figure 8:
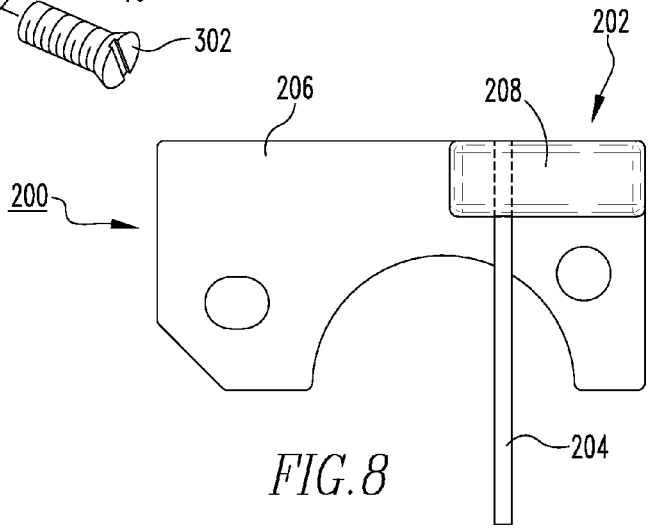

As shown in FIGS. 6-8, the second element 204 of the example anti-bounce assembly 200 is an elongated resilient pin member. The elongated resilient pin member 204 extends outwardly from the first element 202. In operation, the D-shaft 102 includes a closed position, shown in FIGS. 1 and 2, which corresponds to the separable contacts 6 (FIG. 1) being closed. When the D-shaft 102 is disposed in such closed position, the elongated resilient pin member 204 is disposed within the groove 108 and the transverse axis 112 (FIGS. 3 and 5) of the groove 108 is substantially parallel to the elongated resilient pin member 204. In other words, the groove 108 and, in particular the transverse axis 112 (FIGS. 3 and 5), is substantially vertical (e.g., from the perspective of FIGS. 1 and 2). When the D-shaft 102 is not disposed in such closed position, the elongated resilient pin member 204 biases the D-shaft 102 towards such closed position. In this manner, as previously discussed hereinabove, the anti-bounce assembly 200 (FIGS. 1, 2 and 6-8) functions to bias the D-shaft 102 (FIGS. 1-5) toward the desired resting position, thereby helping to ensure proper function of the circuit breaker operating mechanism 8 (FIG. 1), in general.

Continuing to refer to FIGS. 6-8, the first element 202 of the example anti-bounce assembly 200 comprises a mounting segment 206 and a spring-retainer segment 208 extending perpendicularly outwardly from the mounting segment 206. The elongated resilient pin member 204 extends perpendicularly outwardly from the spring-retainer segment 208. Accordingly, the elongated resilient pin member 204 is disposed substantially parallel to the mounting segment 206, as shown in FIGS. 6 and 8.

Referring to FIG. 7, the anti-bounce assembly 200 in the example shown and described herein, further includes a number of fasteners such as, for example and without limitation, the pair of screws 300,302, shown. The screws 300,302 or other suitable fasteners (not shown) are structured to fasten the mounting segment 206 to the circuit breaker housing 4 (partially shown in phantom line drawing in FIG. 7). It will be appreciated, however, that the anti-bounce assembly 200 can be fastened or otherwise secured to the circuit breaker housing 4 using any known or suitable alternative number, type and/or configuration of fastener (not shown) other than the example screws 300,302, or using any known or suitable alternative method (e.g., without limitation, glue) or coupling mechanism (not shown).

As shown in FIGS. 1, 2 and 7, the circuit breaker housing 4 includes at least one sheet member 10 having first and second opposing sides 12,14, and a thru hole 16 (best shown in phantom line drawing in FIG. 7). The aforementioned mounting segment 206 of the anti-bounce assembly 200 is fastened to the first side 12. The spring-retainer segment 208 extends from the first side 12 toward and beyond the second side 14. The D-shaft 102 extends through the thru hole 16, and the groove 108 of the D-shaft 102 is disposed on the second side 14 of the sheet member 10, in order that the elongated resilient pin member 204 cooperates with the D-shaft 102 at or about the groove 108 on the second side 14 of the sheet member 10, as shown in FIGS. 1 and 2.

Accordingly, the disclosed dampening assembly 100 provides a relatively simple and low-cost yet effective mechanism for dampening flutter or vibration, and ensuring proper operational positioning of the D-shaft 102. Among other benefits, the dampening assembly 100 helps eliminate an undesirable trip free condition of the circuit breaker 2. More specifically, the unique anti-bounce assembly 200, in cooperation with the D-shaft 102 incorporating a novel groove 108 disposed therein, serves to bias the D-shaft 102 so as to effectively reduce or eliminate undesirable vibration or flutter of D-shaft 102, as well as to ensure the D-shaft and remainder of the corresponding assembly (e.g., without limitation, latch assembly) comes to the desired rest position for optimal operation.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A dampening assembly for an electrical switching apparatus, said electrical switching apparatus including a housing, separable contacts enclosed by the housing, and an operating mechanism structured to open and close said separable contacts, said dampening assembly comprising:

a D-shaft structured to be pivotably coupled to the housing; and an anti-bounce assembly comprising a first element structured to be coupled to the housing, and a second element adapted to cooperate with said D-shaft to resist undesired movement of said D-shaft, wherein the second element is an elongated resilient pin member extending outwardly from the first element of said anti-bounce assembly.

2. The dampening assembly of claim 1 wherein said D-shaft comprises a first end, a second end disposed opposite and distal from the first end, and a recess disposed between the first end and the second end; and wherein a portion of said elongated resilient pin member is disposed in said recess.

3. The dampening assembly of claim 2 wherein said D-shaft further comprises a longitudinal axis; wherein said recess comprises a groove having a transverse axis; wherein the transverse axis of said groove is substantially perpendicular to the longitudinal axis of said D-shaft; wherein said groove forms an angle with respect to the transverse axis; and wherein said angle is between about 5 degrees and about 30 degrees.

4. The dampening assembly of claim 3 wherein the first element of said anti-bounce assembly comprises a mounting segment and a spring-retainer segment extending perpendicularly outwardly from the mounting segment; and wherein said elongated resilient pin member extends perpendicularly outwardly from said spring-retainer segment.

5. The dampening assembly of claim 4 wherein said anti-bounce assembly further comprises a number of fasteners; and wherein said number of fasteners are structured to fasten the mounting segment to the housing of said electrical switching apparatus.

6. The dampening assembly of claim 4 wherein the housing includes at least one sheet member having a first side, a second side disposed opposite the first side, and a thru hole; wherein the mounting segment of said anti-bounce assembly is structured to be fastened to the first side; wherein the spring-retainer segment of said anti-bounce assembly is structured to extend from the first side toward and beyond the second side; wherein said D-shaft is structured to extend through the thru hole; wherein said groove of said D-shaft is structured to be disposed on the second side; and wherein said elongated resilient pin member is structured to be disposed on the second side, in order to cooperate with said D-shaft at or about said groove.

7. A dampening assembly for an electrical switching apparatus, said electrical switching apparatus including a housing, separable contacts enclosed by the housing, and an operating mechanism structured to open and close said separable contacts, said dampening assembly comprising:

a D-shaft structured to be pivotably coupled to the housing; and an anti-bounce assembly comprising a first element structured to be coupled to the housing, and a second element adapted to cooperate with said D-shaft to resist undesired movement of said D-shaft, wherein said D-shaft comprises a first end, a second end disposed opposite and distal from the first end, and a recess disposed between the first end and the second end;

wherein a portion of said second element is disposed in said recess;

wherein said D-shaft further comprises a longitudinal axis;

wherein said recess comprises a groove having a transverse axis;

wherein the transverse axis of said groove is substantially perpendicular to the longitudinal axis of said D-shaft;

wherein the second element is an elongated resilient pin member; and wherein said elongated resilient pin member extends outwardly from the first element of said anti-bounce assembly.

8. The dampening assembly of claim 7 wherein said D-shaft includes a closed position corresponding to said separable contacts being closed; and wherein, when said D-shaft is disposed in said closed position, said elongated resilient pin member is disposed in said groove and the transverse axis of said groove is substantially parallel to said elongated resilient pin member.

9. The dampening assembly of claim 8 wherein, when said D-shaft is not in said closed position, said elongated resilient pin member biases said D-shaft toward said closed position.

10. An electrical switching apparatus comprising:

a housing;

separable contacts enclosed by the housing;

an operating mechanism for opening and closing said separable contacts; and a dampening assembly comprising:

a D-shaft pivotably coupled to the housing, and an anti-bounce assembly comprising a first element coupled to the housing, and a second element adapted to cooperate with said D-shaft to resist undesired movement of said D-shaft, wherein the second element is an elongated resilient pin member extending outwardly from the first element of said anti-bounce assembly.

11. The dampening assembly of claim 10 wherein said D-shaft comprises a first end, a second end disposed opposite and distal from the first end, and a recess disposed between the first end and the second end; and wherein a portion of said elongated resilient pin member is disposed in said recess.

12. The electrical switching apparatus of claim 11 wherein said D-shaft further comprises a longitudinal axis; wherein said recess comprises a groove having a transverse axis; and wherein the transverse axis of said groove is substantially perpendicular to the longitudinal axis of said D-shaft.

13. The electrical switching apparatus of claim 12 wherein said groove forms an angle with respect to the transverse axis; and wherein said angle is between about 5 degrees and about 30 degrees.

14. The electrical switching apparatus of claimer 13 wherein said D-shaft includes a closed position corresponding to said separable contacts being closed; and wherein, when said D-shaft is disposed in said closed position, said elongated resilient pin member is disposed in said groove and the transverse axis of said groove is substantially parallel to said elongated resilient pin member.

15. The electrical switching apparatus of claim 14 wherein, when said D-shaft is not in said closed position, said elongated resilient pin member biases said D-shaft toward said closed position.

16. The electrical switching apparatus of claim 12 wherein the first element of said anti-bounce assembly comprises a mounting segment and a spring-retainer segment extending perpendicularly outwardly from the mounting segment; and wherein said elongated resilient pin member extends perpendicularly outwardly from said spring-retainer segment.

17. The electrical switching apparatus of claim 16 wherein said anti-bounce assembly further comprises a number of fasteners; and wherein said number of fasteners fasten the mounting segment to the housing of said electrical switching apparatus.

18. The electrical switching apparatus of claim 17 wherein said electrical switching apparatus is a circuit breaker; wherein the housing of said circuit breaker includes at least one sheet member having a first side, a second side disposed opposite the first side, and a thru hole; wherein the mounting segment of said anti-bounce assembly is fastened to the first side; wherein the spring-retainer segment of said anti-bounce assembly extends from the first side toward and beyond the second side; wherein said D-shaft extends through the thru hole; wherein said groove of said D-shaft is disposed on the second side; and wherein said elongated resilient pin member is disposed on the second side, in order to cooperate with said D-shaft at or about said groove.

* * * * *